United States Patent [19]

Berman et al.

[11] Patent Number: 4,549,110

[45] Date of Patent: Oct. 22, 1985

[54] MAGNETIC FLUORESCENT LAMP HAVING REDUCED ULTRAVIOLET SELF-ABSORPTION

[75] Inventors: Samuel M. Berman, San Francisco, Calif.; Robert W. Richardson, Pelham, N.Y.

[73] Assignee: The United States of America as represented by the Department of Energy, Washington, D.C.

[21] Appl. No.: 566,849

[22] Filed: Dec. 29, 1983

[51] Int. Cl.[4] ..... H01J 61/38; H05B 31/28

[52] U.S. Cl. ..... 313/485; 313/161; 315/347

[58] Field of Search ..... 313/485, 486, 160, 161, 313/156; 315/260, 262, 264, 338, 344, 347

[56] References Cited

U.S. PATENT DOCUMENTS

| | | | |
|---|---|---|---|
| 3,521,120 | 7/1970 | Anderson | 315/57 |
| 4,177,401 | 12/1979 | Yamane et al. | 313/485 |
| 4,187,446 | 2/1980 | Gross et al. | 315/58 |
| 4,311,942 | 1/1982 | Skeist et al. | 315/62 |
| 4,311,943 | 1/1982 | Gross et al. | 315/70 |
| 4,316,121 | 2/1982 | Hammer et al. | 315/62 |
| 4,341,977 | 7/1982 | Gross et al. | 313/485 |
| 4,341,979 | 7/1982 | Gross et al. | 315/57 |
| 4,386,296 | 5/1983 | Beck | 315/53 |

OTHER PUBLICATIONS

Watanabe et al., "Multichannel Discharges in Low-Pressure Rate-Gas-Mercury Mixtures Caused by Anode Oscillation," J. Appl. Phys. vol. 51, No. 12, 12/80, pp. 6124-6129.

Richardson et al., "Theory of the Effects of Magnetic Fields and Isotope Enrichment of the Radiant Emittance of the Hg-Ar Discharge", Lawrence Berkeley Laboratory, University of CA, Lighting System Research, 1983.

Hollister et al., "Experimental Studies of Enhanced Emittance by Zeeman Splitting of a Low Pressure Hg/Ar Discharge", Ibid., 1983.

Sun et al., "Experimental Studies of Enhanced Emittance by Isotope Enrichment of a Low Pressure Hg/Ar Discharge", Ibid., 1983.

*Primary Examiner*—David K. Moore
*Assistant Examiner*—K. Wieder
*Attorney, Agent, or Firm*—Clifton E. Clouse, Jr.; Roger S. Gaither; Judson R. Hightower

[57] ABSTRACT

The radiant emission of a mercury-argon discharge in a fluorescent lamp assembly (10) is enhanced by providing means (30) for establishing a magnetic field with lines of force along the path of electron flow through the bulb (12) of the lamp assembly, to provide Zeeman splitting of the ultraviolet spectral line. Optimum results are obtained when the magnetic field strength causes a Zeeman splitting of approximately 1.7 times the thermal line width.

9 Claims, 5 Drawing Figures

MAGNETIC FLUORESCENT LAMP HAVING REDUCED ULTRAVIOLET SELF-ABSORPTION

The U.S. Government has rights in this invention pursuant to Contract No. DE-ACO3-76SF00098 between the U.S. Department of Energy and the University of California.

BACKGROUND OF THE INVENTION

The present invention relates generally to fluorescent lamps and more particularly to a fluorscent lamp assembly having an internal magnetic field.

A conventional fluorescent lamp consists of a tubular glass bulb capped by two bases which are fitted with pins to carry electricity to the internal electrodes. Inside the bulb are minute droplets of mercury and an inert gas, usually argon or an argon-neon mixture. The inside of the bulb is coated with phosphor powders which will fluoresce when exposed to ultraviolet radiation.

When a voltage is imposed on the electrodes, electrons will be emitted, ionizing the gas inside the tube. The ionized gas is an electrical conductor and an electron flow in the form of an arc discharge will be established between the electrodes, with the heat of this arc causing the mercury droplets in the bulb to vaporize. The electrons are accelerated by the voltage across the electrodes and will collide with the mercury atoms, exciting them to states of higher energy. As the excited mercury atoms return to their ground state, photons of electromagnetic energy, both in the visible and the ultraviolet ranges, will be emitted. The lamps operate at low pressure to enhance the ultraviolet radiation which exites the phosphor coating to luminance at longer, visible, wavelengths. The resulting light output is not only much higher than that obtained from the visible mercury lines alone, but also results in a continuous spectrum.

One of the problems with fluorescent lamps is the loss of efficiency due to the ultraviolet self-absorption inherent in such lamps. An emitted ultraviolet photon can also collide with a ground state mercury atom and excite it to a higher energy level. As that excited atom returns to its ground state, another ultraviolet photon of the same amount of energy will be emitted. Thus, the ultraviolet photons emitted as a result of electron excitation can be absorbed and re-emitted by mercury atoms as the photons radiate outwardly to the fluorescent coating. Generally, the greater the distance from the point of electron excitation to the fluorescent coating, the greater the number of times that the emitted photon will be re-absorbed and re-emitted. There is no energy loss, of course, in the excitation of a ground state mercury atom by a photon, since the energy absorbed by the atom will be all re-emitted as the excited atom returns to its ground state. However, the density of excited mercury atoms in the tube will be increased by such absorption of photons, thereby increasing the number of collisions of electrons with excited mercury atoms. Such collisions will result in an absorption of energy which will not then be released as ultraviolet radiation.

Various attempts have been made in an effort to reduce the problem of self-absorption by causing the arc discharge to spread out through the bulb, thereby decreasing the average distance from electron-excited mercury atoms to the fluorescent coating. For example: U.S. Pat. No. 4,341,977, discloses a mercury-argon fluorescent lamp with Freon used to cause arc spreading; U.S. Pat. No. 4,311,943 uses glass or quartz fibers, in conjunction with a magnetic-field arc-spreading coil to spread the arc; U.S. Pat. No. 4,311,942 uses an alternating current to create an expanding and contracting magnetic field to spread the electrons in the arc; U.S. Pat. No. 4,177,401 uses a permanent magnet situated so as to cause the arc to rotate about the axis of the lamp; U.S. Pat. No. 4,341,979 shows the use of coils designed to generate a rotating magnetic field in the lamp so that the arc will spread.

In spite of these efforts, the problem still remains of providing an economical and efficient manner of reducing the amount of ultraviolet self-absorption in fluorescent lamps.

SUMMARY OF THE INVENTION

It is an object of the invention to provide a fluorescent lamp system in which the energy loss associated with the ultraviolet self-absorption of conventional fluorescent lamps is significantly reduced.

It is a further object of the invention to provide a fluorescent lamp system which will significantly decrease the cost of operation.

Additional objects, advantages and novel features of the invention will be set forth in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, a fluorescent lamp assembly is provided, such system having a bulb containing an inert gas and mercury, means for causing an electron flow along a predetermined path within the bulb, and means for establishing a magnetic field having lines of force extending along the path of electron flow.

It is also preferred that the magnetic field be of a strength such that the Zeeman splitting of the ultraviolet resonance radiation is approximately 1.7 times the thermal line width of the radiation.

It is also preferred that the magnetic field be in the range of 200 to 1000 gauss, with maximum efficiency being obtainable at a field strength of about 700 gauss.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
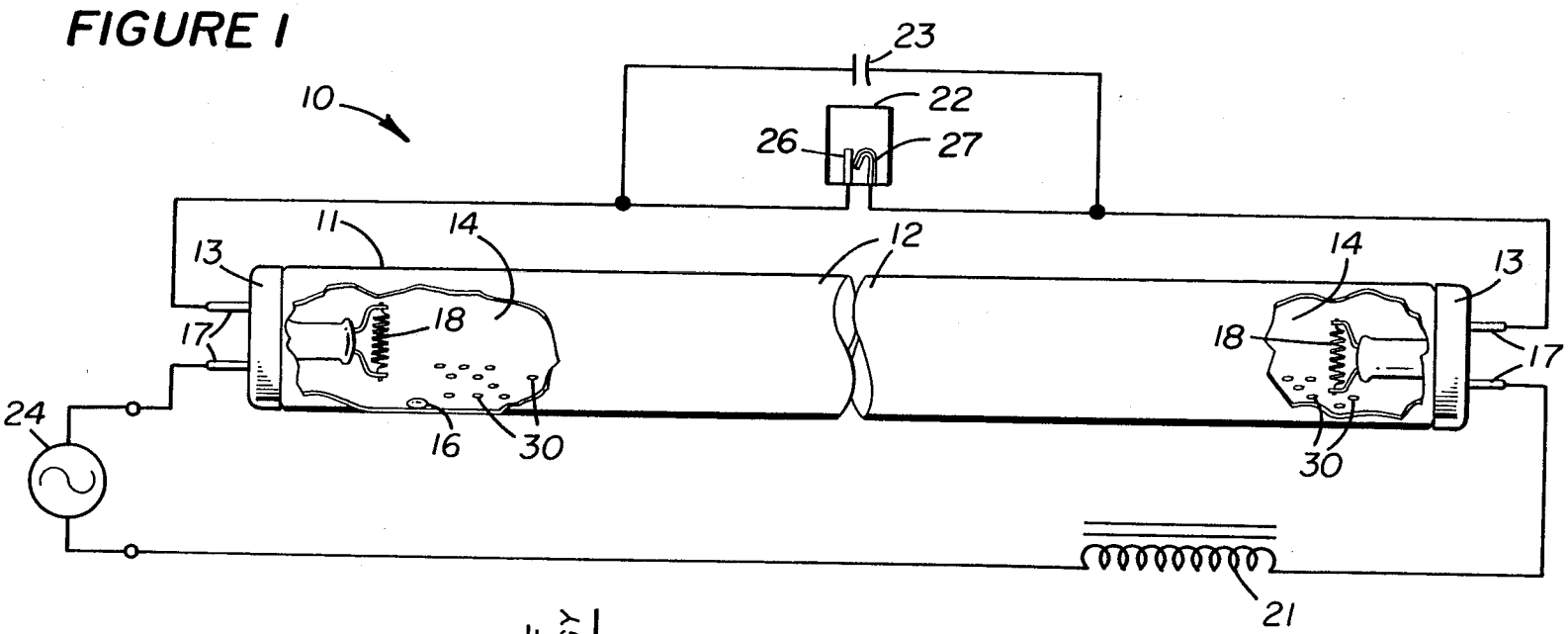
FIG. 1 is a sectional and partly schematic view of a fluorescent lamp assembly having a magnetic field in accordance with the invention.

Referring now to the drawings, which illustrate a preferred embodiment of the invention, the fluorescent lamp assembly 10 shown in FIG. 1 may include an elongated, tubular, glass bulb 12 closed at both ends by end plates 13. The bulb 12 is coated on the inside with a phosphor powder coating 14 which will fluoresce when excited by ultraviolet radiation. The interior of the bulb is filled with an inert gas, such as argon and contains minute droplets, exemplified at 16, of mercury. Terminal pins 17 extend through the end plates 13 and are electrically connected to the electrodes 18. The lamp assembly 10 may also include an inductive ballast 21, a neon glow switch starter 22, and a capacitor 23 to reduce radio-frequency interference.

The fluorescent lamp may be started by connecting the assembly 10 to a source 26 of alternating current. The voltage at contacts 26 and 27 of the glow switch will form an arc between the contacts. Contact 27 is a bimetallic strip which will unbend in the heat of the arc and engage contact 26 to close the switch. The higher current now flowing through the circuit will heat the electrodes 18 of the fluorescent bulb 12. With the arc in the glow switch 22 extinguished, the contact 27 will cool, the switch will open, and the reactance of ballast 21 will impose a high voltage on the heated electrodes 18, sufficient to start an arc discharge through the bulb. From this point on, all the current flows through the bulb; the glow switch 22 is out of the circuit. Once the arc discharge starts, a hot electron-emitting electrode temperature is maintained through mercury ion bombardment.

In accordance with the present invention a magnetic field is established with lines of force extending along the path of electron flow through the bulb. In the embodiment illustrated in FIG. 1, the phosphor coating 14 includes ferrite particles, exemplified at 30. Alternatively, a phosphor which itself is a ferrite may be used in the phosphor coating. In either case, magnetization of the ferrite in a strong field during manufacture will leave a residual magnetism when the exciting field is removed. In the embodiment shown in FIG. 1, wherein the bulb 12 is an elongated tube, with an axial path of electron flow, the magnetic field established by the magnetized ferrite particles will also be axial of the tube. The optimum value of the magnetic field is about 700 gauss, as discussed below.

With the arc discharge established, collisions of electrons with ground state mercury atoms will exite the atoms to the various ultraviolet and visible energy states of the mercury spectral lines. The greatest density of excited atoms will be at the first resonance level. After excitation to this level, the atoms will return to their ground state, emitting photons of radiant energy at the frequency of the first resonance line of the mercury spectrum, that is, at 2537 A. in the ultraviolet region. These photons will have an energy proportional to their frequency, in accordance with the equation $e=hv$, wherein h is the Planck constant, and v is the frequency difference between ground state and the triplet P state or resonance state.

Figure 2:
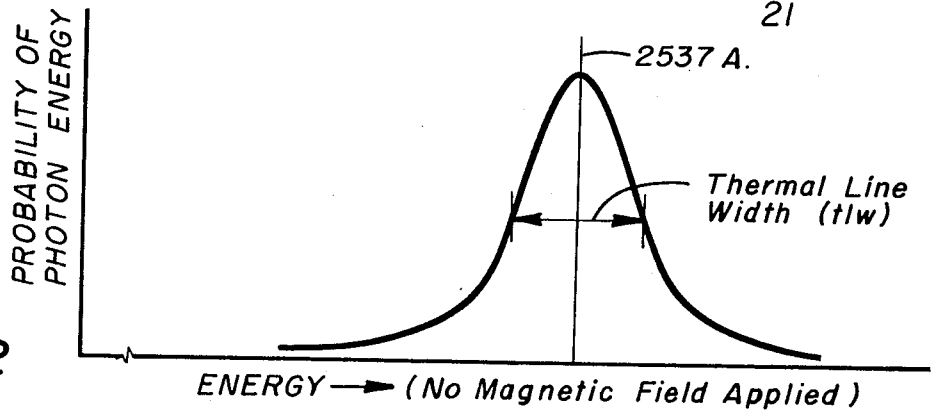
FIG. 2 is a graph of the probability of photon energy in a fluorescent lamp with no magnetic field applied.

FIG. 2 illustrates the distribution of emitted photon resonance energy in the ultraviolet range when no magnetic field is applied to the bulb, i.e. as in the operation of conventional fluorescent lamps. There is a spreading of the radiation frequencies of the photons, centered on 2537 A., with a resulting broadening of this spectral line, which takes place because the radiating atoms do not all have the same velocity to the observer, so that they give rise to different Doppler shifts. This broadening increases with increasing temperatures. The thermal line width is defined as the full width of the gaussian distribution curve at one-half maximum.

Figure 3:
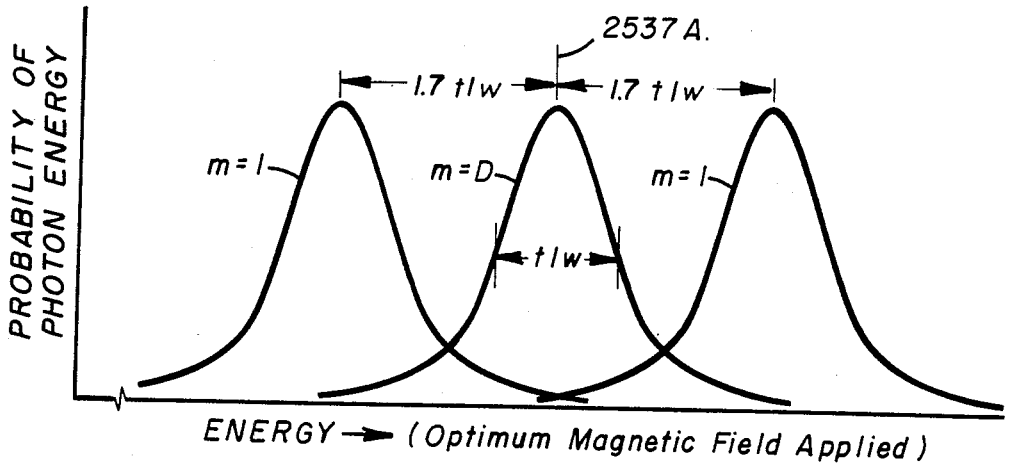
FIG. 3 is a graph of the probability of photon energy with a magnetic field applied of a magnitude to cause optimum Zeeman splitting of the excitation levels.
Figure 4:
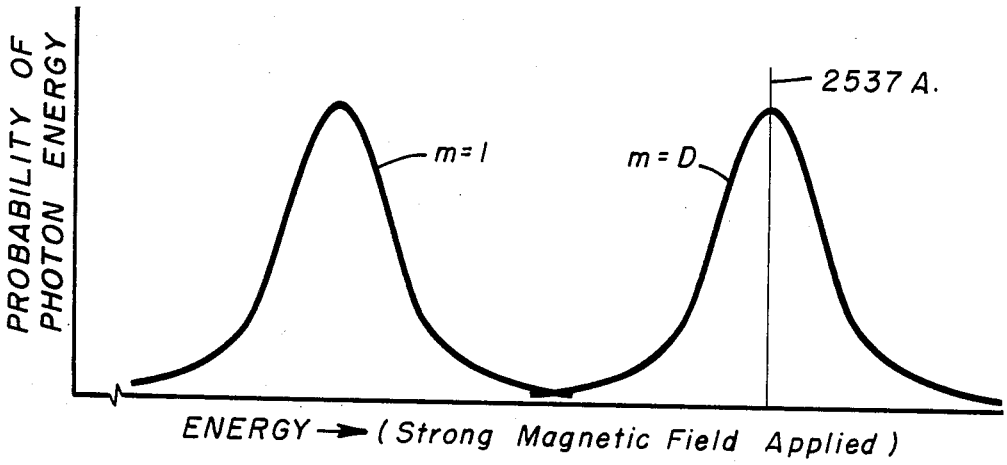
FIG. 4 is a graph of the probability of photon energy with a strong magnetic field applied.

FIGS. 3 and 4 illustrate the effect of imposing a magnetic field on the arc discharge, with the lines of force being along the path of electron flow through the bulb.

Such a field will cause a splitting of the spectral line into three lines, $m=0$ and $m=\pm 1$, m being the magnetic quantum member and with the amount of the splitting being dependent on the strength of the magnetic field. The middle line, $m=0$, will have the same frequency as the original spectrum line, and the $m=-1$ and $m=1$ lines will be lower and higher, respectively, in frequency. Such a spectral line splitting by the application of a low level magnetic field is commonly referred to as the Zeeman effect. Since energy is proportional to frequency, each of the three split spectral lines will have a different resonant energy level. Each of the three energy spectral lines is similarly broadened, with the thermal line width of each being the same.

The amount of shift of the spectral lines and of the associated resonant energy levels is proportional to the magnitude of the applied magnetic field. In FIG. 3, the shift is of a magnitude such that there is a significant overlap of the wings of the distribution curves for the $m=0,\pm 1$ lines. In FIG. 4, the shift is of a magnitude such that the spectral lines are displaced sufficiently far so that there is no significant overlap of the distribution curves. In this latter case, there will be emittance of three independent ultraviolet lines, each at one-third of the value at zero magnetic field.

Figure 5:
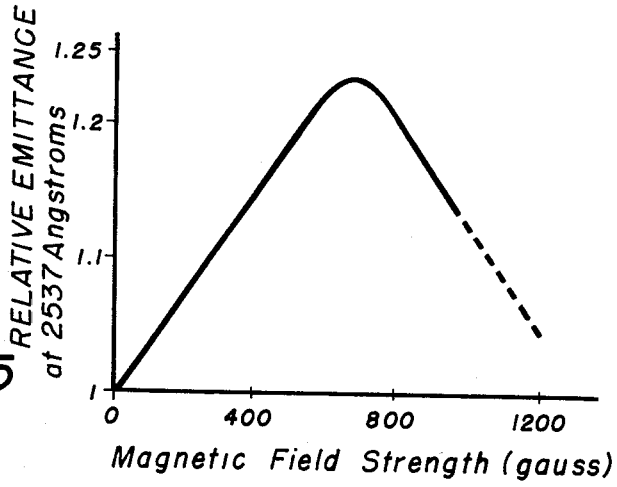
FIG. 5 is a graph illustrating the relation of relative emittance to magnetic field strength.

It has been found that the application of a magnetic field at the proper strength will substantially reduce the ultraviolet self-absorption, and such findings are illustrated in FIG. 5. The emittance of a fluorescent tube with no magnetic field applied, i.e. as in FIG. 2, is taken as unity. As a magnetic field is applied, the measured emittance increases, with maximum emittance being achieved with a field strength of about 700 gauss. Such a field will produce a Zeeman splitting of the resonant radiation of a magnitude as illustrated in FIG. 3 wherein the shift is approximately 1.7 times the thermal line width. At such point, the radiation emittance is about 25% greater than the emittance at zero field. A further increase in field strength will cause a reduction in enhanced emittance, to a point where the field strength is high enough to cause a non-overlapping of the lines, as illustrated in FIG. 4. A further increase in magnetic field strength beyond that point will have no further effect on the relative emittance of the fluorescent tube.

It is theorized that the enhanced emittance is achieved as the result of the diffusion of photons in frequency. The photons diffuse in frequency out of the line cores where the medium is opaque and into the line wings where it is transparent and they escape. This effect is enhanced when the line wings overlap.

In any event, for a lamp constructed in accordance with the invention, maximum efficiency is achieved with a magnetic field of about 700 gauss, with significant improvement being obtained when the field is in the range of about 200 to about 1000 gauss.

The increased ultraviolet emittance provided by the present invention will give an increased output of visible light. A lamp with a 15% improvement in efficiency, i.e. lumens per watt, and costing even as much as 50% more than the typical fluorescent lamp, would pay back the increased first cost by savings of electricity costs with a payback period approximately 25% of the lamp life.

The foregoing description of a preferred embodiment has been presented for purposes of illustration and description. It is not intended to be exhaustive or to limit the invention to the precise form described, and obviously many modifications and variations are possible in light of the above teaching. For example, external magnetic coils as part of the ballast can be electrically energized to produce an alternating current magnetic field inside the bulb to achieve the desired Zeeman splitting of the ultraviolet spectral line. Likewise, the bulb may be of a shape other than that of a tube. The embodiment shown was shown and described in order to best explain the principles of the invention and its practical applications to hereby enable others in the art to best utilize the invention in various embodiments and with various modifications as are suited to the particular use contemplated. It is intended that the scope of the invention be defined by the claims appended hereto.

We claim:

1. A fluorescent lamp assembly comprising:

a bulb containing an inert gas and mercury, a phosphor coating on said bulb, means for causing an electron flow along a predetermined path through said bulb, and means for establishing a magnetic field having lines of force extending along said path of electron flow, said magnetic field having a strength such that the Zeeman splitting of the ultraviolet resonance radiation is approximately 1.7 times the thermal line width of that radiation.

2. A fluorescent lamp assembly as set forth in claim 1, wherein the magnetic field established by said field establishing means has a magnitude in the range of from 200 to 1000 gauss.

3. A fluorescent lamp assembly as forth in claim 1, wherein the magnetic field established by said field establishing means has a magnitude of approximately 700 gauss.

4. A fluorescent lamp assembly as set forth in claim 1, wherein said bulb is an elongated tube, wherein said means for causing an electron flow includes an electrode at each end of said tube, and wherein the magnetic field established by said field establishing means is axial of said tube.

5. A fluorescent lamp assembly as set forth in claim 4, wherein the magnetic field established by said field establishing means has a magnitude in the range of from 200 to 1000 gauss.

6. A fluorescent lamp assembly as set forth in claim 4, wherein the magnetic field established by said field establishing means has a magnitude of approximately 700 gauss.

7. A fluorescent lamp assembly as set forth in claim 4, wherein said field establishing means comprises magnetized magnetic particles in said phosphor coating.

8. A fluorescent lamp assembly as set forth in claim 7, wherein the magnetic field established by said magnetized particles has a magnitude in the range of from 200 to 1000 gauss.

9. A fluorescent lamp assembly as set forth in claim 7, wherein the magnetic field established by said magnetized particles has a magnitude of approximately 700 gauss.

* * * * *